United States Patent [19]

Liedholm

[11] 4,339,167

[45] Jul. 13, 1982

[54] FLAT CONDUCTOR TO ROUND CONDUCTOR CONNECTION SYSTEM

[75] Inventor: David W. Liedholm, Fremont, Calif.

[73] Assignee: Raychem Corporation, Menlo Park, Calif.

[21] Appl. No.: 129,896

[22] Filed: Mar. 13, 1980

Related U.S. Application Data

[63] Continuation of Ser. No. 937,889, Aug. 29, 1978, abandoned.

[51] Int. Cl.[3] ..... H01R 9/10

[52] U.S. Cl. ..... 339/272 A

[58] Field of Search ..... 339/198 G, 198 GA, 198 H, 339/272 R, 272 A, 272 UC

[56] References Cited

U.S. PATENT DOCUMENTS

| | | | |
|---|---|---|---|
| 1,741,804 | 12/1929 | Zilliox | 339/272 UC |
| 2,068,152 | 1/1937 | Rowe | 339/272 R |
| 2,434,604 | 1/1948 | West | 339/272 UC |
| 2,922,139 | 1/1960 | Ustin | 339/198 G |
| 4,040,711 | 8/1977 | Waddington et al. | 339/272 A |

*Primary Examiner*—Joseph H. McGlynn

*Attorney, Agent, or Firm*—Lyon & Lyon

[57] ABSTRACT

There is disclosed herein power connection clamp pads shaped to fit the contour of conductors to be attached to terminal blocks for insertion into known terminal block assemblies.

3 Claims, 3 Drawing Figures

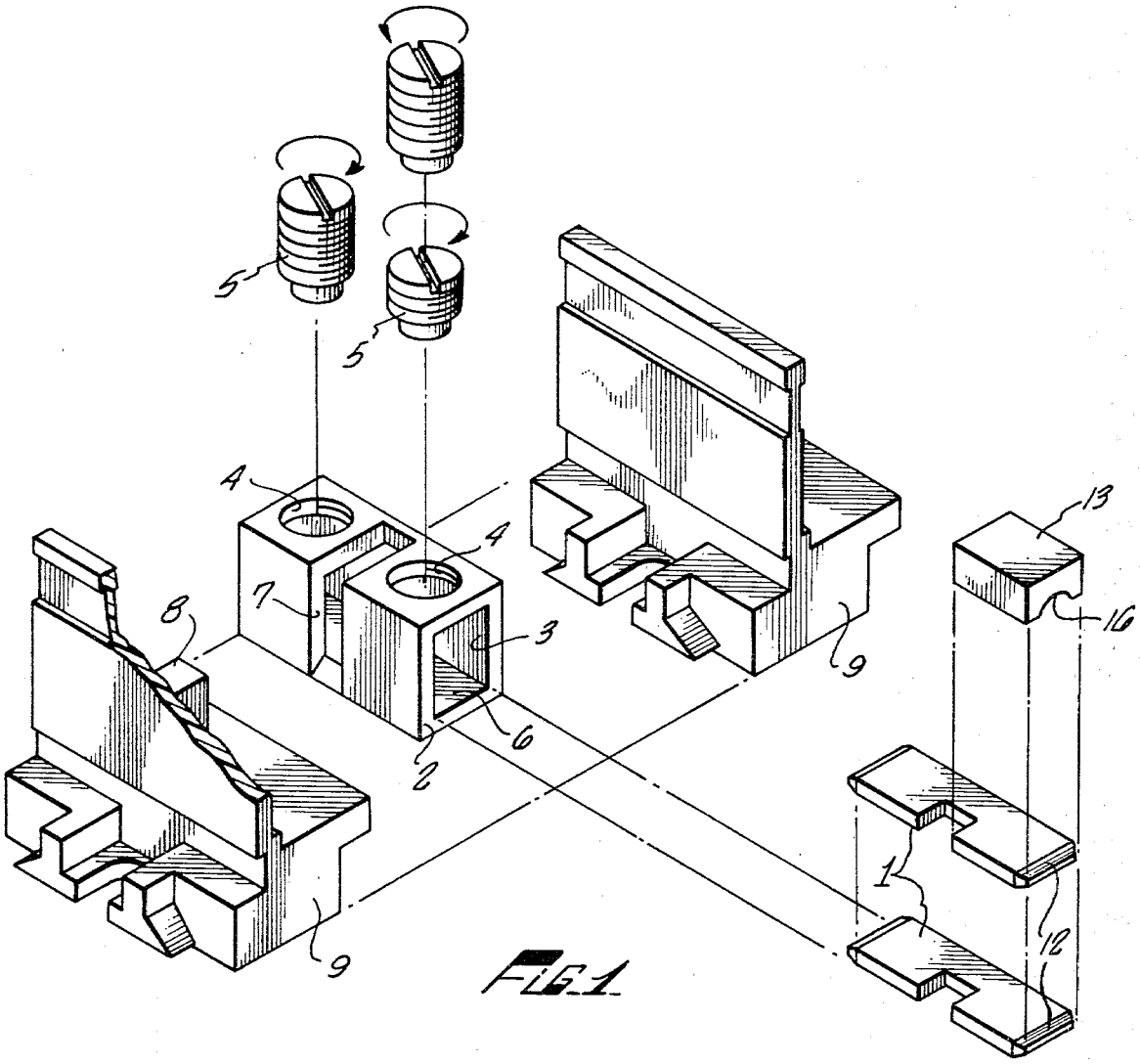
FIG. 1
FIG. 2
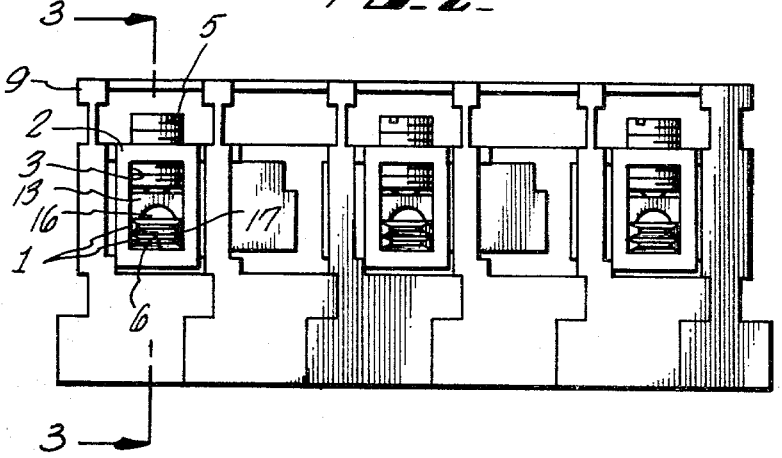

FLAT CONDUCTOR TO ROUND CONDUCTOR CONNECTION SYSTEM

RELATED APPLICATIONS

This is a continuation of application Ser. No. 937,889, filed Aug. 29, 1978, now abandoned.

The subject matter of this application relates to the subject matter of pending application Ser. No. 903,360 entitled "Strip Heater Expansion Joint", filed Aug. 31, 1978, and to the subject matter of pending application Ser. No. 938,591, entitled "Flat Conductor Heater", filed Aug. 31, 1978, the disclosures of which are incorporated herein by reference.

BACKGROUND OF THE INVENTION

The present invention relates to the field of terminal block connection systems, and, more particularly, to a system for adapting standard off-shelf terminal blocks to a configuration particularly suited for connecting round conductors to flat conductors.

Heretofore, many terminal block connection devices adapted for use with round or flat conductors generally used screws to clamp the conductors to a terminal contact without any insert or pad between the screw and the conductor. When a connection between a flat conductor on one side of a terminal strip was to be made to a round conductor on the other side, difficulties were encountered in achieving a secured connection due to the different shapes of the conductors. One problem was that stranded wire tended to separate and go flat under pressure of the screw.

Some prior art terminal blocks, for example the Buchanan tubular screw catalogue number B102S for use in the Buchanan one-piece phenolic terminal blocks, used rounded pads attached to the tubular screw to bring pressure to bear on the round wire while forcing it to maintain its shape. However, these pads were attached to the tubular screw on both sides of the terminal block. Consequently, the other side of the terminal block was not satisfactory for connecting to a flat conductor because, with a rounded pad, only the edges contacted a flat conductor.

Problems were also encountered in the prior art in connecting different sizes of wire to different sides of the terminal strip. For example, when a large round wire was to be attached to a smaller flat wire, the prior art terminal blocks could not effectively be used off the shelf.

SUMMARY OF THE INVENTION

The present invention is directed to an apparatus to solve the problems concomitant with attempts to use off-shelf terminal blocks in round to flat conductor connection applications and is summarized as follows.

A standard off-shelf terminal block of the type having a frame and terminal block contacts is modified by use of inserts in the terminal block contacts. The terminal block contacts used are rectangular channel tubular screws which are well-known to those skilled in the art. One or more flat connection plates is inserted in the channel of the terminal block contact and a shoulder on the terminal block frame engages a groove in the flat connection plate through a second slot in the terminal block contact. This groove and shoulder engagement is intended to prevent the flat connection plates from falling out during shipment to a job or during installation in other than a horizontal position. As many flat connection plates may be inserted as are necessary to accommodate the size of the flat conductor being used.

A contoured clamp pad is inserted in the end of the channel of the terminal block contact between the screw means and the non-flat conductor. Its purpose is to transmit pressure from the screw to the non-flat conductor over its entire surface rather than at only one point or a small portion of the surface. The contoured clamp pad extends only partially through the channel of the terminal block contact, that is, the contoured clamp pad is placed under only one of the two screws of each terminal block contact so that it clamps only the round conductor and not the flat one. In round to flat conductor connection applications, the round conductor is clamped by the contoured clamp pad to a flat connection plate resting on the bottom of the channel of the terminal block contact.

A primary object of the present invention is to provide apparatus for use in converting standard prior art terminal blocks to a structure adapted for round wire to flat wire connections.

Another object is to provide apparatus to modify prior art terminal blocks such that both large and small gauge wires could be effectively clamped in the same terminal block merely by changing the number of flat connection plates inserted in the channel of the terminal block contact.

BRIEF DESCRIPTION OF THE DRAWINGS

FIG. 1 is an exploded view in perspective of a typical off-shelf terminal block assembly showing the arrangement of the flat connection plates and contoured clamp pads.

FIG. 2 is a front view of a typical terminal block assembly with the flat connection plates and contoured clamp pad in place.

DETAILED DESCRIPTION OF THE PREFERRED EMBODIMENT

Figure 3:
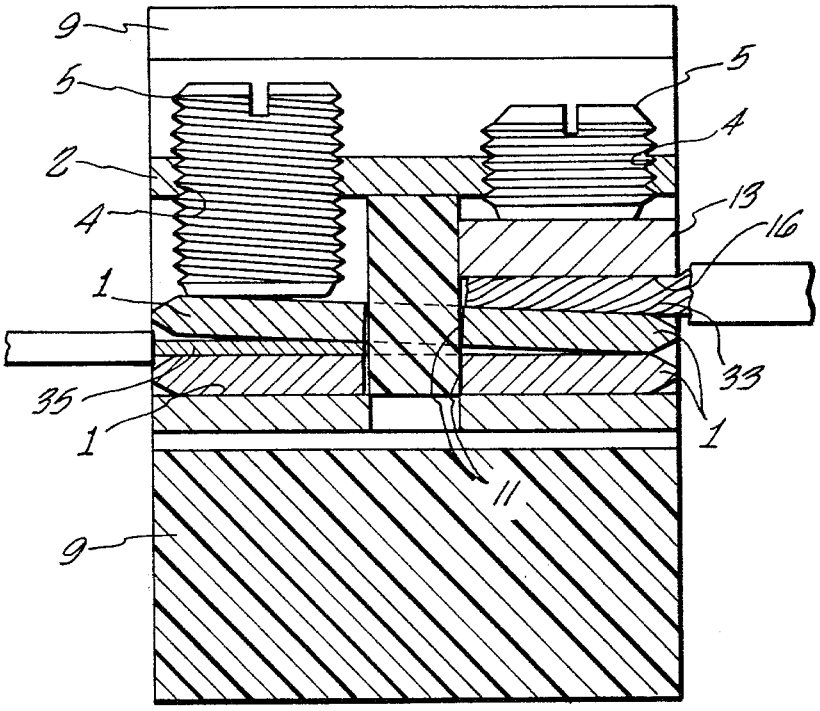
FIG. 3 is a cross-sectional view of the terminal block assembly of FIG. 2 with a flat conductor and a round conductor in place.

Referring to FIG. 1, a standard off-shelf terminal block 9 is shown in its disassembled form as two halves. Each half is made of a non-conducting material. Terminal block contact 2 is a metal block with a hollow rectangular channel 3 therein. Two apertures 4 receive clamp means 5 which, in the preferred embodiment, are threaded screws. The purpose of these screws is to clamp conductors inserted into the ends of rectangular channel 3 to the bottom 6 of this channel on both ends. Terminal block contact 2 has a slot 7 cut therein to receive a shoulder 8 protruding from terminal block 9. Shoulder 8 serves to prevent terminal block contact 2 from being dislodged after the halves of terminal block 9 are assembled.

Flat connection plate means 1 are sized to fit channel 3 and are inserted in channel 3 so that they lie along bottom 6 and under both clamp means 5. The purpose of these flat connection plates 1 is to transmit clamping pressure from clamp means 5 to a flat conductor (not shown) placed between the flat connection plates 1 or between a flat connection plate 1 and bottom 6 of channel 3. A stronger connection is formed by use of these flat plates 1 to transmit the clamping pressure to the entire surface of the flat conductor rather than only at the point of contact between the screw and the flat conductor. Often clamp means 5 is a screw which has a small projection at its end, shown at 10 in FIG. 2, which prevents contact between the entire bottom of clamp means 5 and the conductor. The number of these flat connection plates 1 used depends upon the size of the flat conductor and the length of clamp means 5.

The flat connection plate 1 extends along the entire length of the hollow rectangular channel 3. Flat connection plates 1 have grooves 11 formed therein for purposes of engaging shoulder 8 of terminal block 9 when the plates are inserted in channel 3. By so engaging shoulder 8, the flat connection plates 1 are retained in channel 3 during shipment to a job site or during installation in non-horizontal positions before clamp means 5 is tightened down.

Contoured clamp pad means 13 is a metallic block with a contoured surface 16 conforming to the shape of the conductor which is not necessarily round. Contoured clamp pad 13 is inserted into channel 3 between clamp means 5 and a non-flat conductor to be clamped. The non-flat conductor fits between contoured clamp pad 13 and said flat connection plate 1 and is clamped to flat connection plate 1 pressure transmitted from clamp means 5 through contoured clamp pad 13 to the conductor.

Both flat connection plate 1 and contoured clamp pad 13 are sized to fit within the channel 3 of terminal block contact 2 which can be a Buchanan Terminal Block Contact, part number 0615060000.

Use of flat connection plate 1 and contoured clamp pad 13 is made in connecting the flat conductor heater, disclosed in the co-pending "Flat Conductor Heater" application, incorporated by reference herein to a three-phase power supply having round conductors. Specifically, in FIG. 3 of the "Flat Conductor Heater" application, a terminal box 6 contains terminal block 9. Terminal block 9 is connected to three-phase power supply transformer 7. Referring to FIG. 2 herein and FIG. 3 of the cross-referenced "Flat Conductor Heater" application, the three round conductors coming from transformer 7 are clamped by surface 16 between contoured clamp pad 13 and one of two flat connection plates 1 inserted in the channels 3 of each of the three terminal block contacts 2 of terminal block 9. On one or both sides of these three terminal block contacts 2, the flat conductors of the strip heater are inserted at point 17 between flat connection plates 1. Then, clamp means 5 is tightened down on both sides to secure the connection. At the end of the flat conductor heater, another terminal box 18 contains a terminal block 14. There, an E-shaped shorting bar is connected as a flat conductor to the opposite side of the three terminal block contacts 2 from the side connecting the flat conductors of the strip heater.

FIG. 3 is a cross-sectional view of a portion of the assembled terminal block of FIG. 2 with a round conductor 33 and a flat conductor 35 mounted therein. The flat conductor 35 is mounted at point 17 between the flat connection plates 1 and the round conductor 35 is clamped between the contoured surface 16 of the contoured clamp pad 13 and one of the two flat connection plates 1.

Although the invention has been described in terms of a preferred embodiment, other embodiments incorporating the concepts disclosed herein are intended to be included.

What is claimed is:

1. In a connection apparatus having a terminal block of nonconducting material with a terminal block contact of conducting material attached thereto, said terminal block contact having a channel therethrough and at least two positions for receiving conductors and having clamp means for clamping said conductors to said terminal block contact at each position for receiving conductors, the improvement which comprises:

a contoured clamp pad not connected to said clamp means and having a surface conforming to the shape of a nonflat conductor for disposition between said clamp means and such nonflat conductor for transmitting clamping pressure from said clamping means to the surface of such a nonflat conductor, said contoured clamp pad being sized to fit within said channel and extend over only a first portion of the length of the channel so that a second portion of the terminal block contact can be used for a flat conductor; and two flat connection plates sized to fit within said channel and extend over the length thereof and adapted so that a flat conductor can be clamped between the plates in the second portion of the channel, the flat connection plates being positioned so that the non-flat conductor can be clamped between the contoured clamp pad and one of the plates.

2. An apparatus as defined in claim 1, wherein said terminal block contact comprises a slot through to said hollow channel and perpendicular to the axis of said channel, said terminal block contact having a shoulder extending through said slot into said channel, and wherein each of said flat connection plates has a groove therein disposed to engage said shoulder for retention of said flat connection plates in said channel when said clamp means is not clamping said flat connection plates to said terminal block contact.

3. An apparatus as defined in claim 2 wherein said channel is rectangular in cross-section.

* * * * *